US005813353A

United States Patent [19]

Sauter

[11] Patent Number: 5,813,353

[45] Date of Patent: Sep. 29, 1998

[54] GONDOLA RAILCAR

[75] Inventor: Lynn B. Sauter, Windber, Pa.

[73] Assignee: Johnstown America Corporation, Chicago, Ill.

[21] Appl. No.: 786,920

[22] Filed: Jan. 23, 1997

[51] Int. Cl.[6] ..... B61D 17/00

[52] U.S. Cl. ..... 105/406.1

[58] Field of Search ..... 105/247, 248, 105/406.1, 411, 416

[56] References Cited

U.S. PATENT DOCUMENTS

| | | | |
|---|---|---|---|
| 1,813,537 | 7/1931 | Gilpin | 105/406.1 |
| 4,082,045 | 4/1978 | McNally et al. | 105/406.1 |
| 4,361,097 | 11/1982 | Jones et al. | 105/406.1 |
| 4,408,542 | 10/1983 | Heap | 105/406.1 |
| 4,930,427 | 6/1990 | Ritter et al. | 105/406.1 |
| 5,458,067 | 10/1995 | Weiss et al. | 105/406.1 |

*Primary Examiner*—S. Joseph Morano
*Attorney, Agent, or Firm*—Webb Ziesenheim, Bruening Logsdon Orkin & Hanson, P.C.

[57] ABSTRACT

A gondola car having a pair of longitudinally extending tubs disposed on opposite sides and forming a depressed, curvilinear floor. Center sill connection plates are attached to the top of the center sill and include vertically disposed flanges. A portion of the connection plates are formed by L-shaped members which are disposed in overlapping relationship.

23 Claims, 8 Drawing Sheets

GONDOLA RAILCAR

BACKGROUND OF THE INVENTION

1. Field of the Invention

This invention relates in general to rail cars and, more particularly, to a gondola rail car employing lower curvilinear floor panels.

2. Summary of the Prior Art

In the prior art, gondola rail cars are employed to transport bulk material, such as coal and other granular lading. A well known type of gondola car is disclosed in U.S. Pat. No. 4,361,097 to Jones, et al., issued Nov. 30, 1982. Gondola cars of the type shown in the foregoing Jones, et al. patent include longitudinally extending tub members formed by curvilinear floor panels attached on each side of a continuous center sill. The use of troughs or tubs in a gondola car increases its capacity and lowers its center of gravity for better handling results. In the rail car shown in the Jones, et al. patent, the tub members are attached directly to the center sill itself. While such a technique is satisfactory for certain cross-sectional shapes of center sills, a direct attachment is not satisfactory when the center sill possesses projecting lateral portions, such as a lower horizontal flange. Protruding lower flanges are found on certain types of center sills such as, for example, center sills having a pair of Z portions welded together.

In a typical gondola car, the side walls are reinforced by a plurality of braces existing at various locations along the length of the car body. In one form of a brace, the beams form a K-shape in that its cross beams, vertical beams and diagonal beams approximate such a configuration. It is desirable in prior art to provide an improved technique of attachment of such bracing elements to minimize the number of bracing components needed to maintain the structural integrity of the car body. The reduction of bracing elements in a rail car is desirable to minimize weight and provide a more economical car. Accordingly, it is desirable in the prior art to provide an improved gondola car containing enhanced attachment of its body components.

SUMMARY OF THE INVENTION

It is, therefore, an objective of the invention to provide an improved gondola rail car for carrying commodities, such as coal and the like. The gondola car herein disclosed is provided with a unique bracing assembly by which the gondola body is adequately strengthened by a minimum number of components interconnected with the center sill and the opposed side walls. The invention further includes a pair of longitudinal tubs having curvilinear panels which are affixed to unique center sill attachment plate means for improved securement and ease of manufacture. The center sill connection plate means includes vertical flanges disposed at a proper location to permit the lower tub members to be attached to the center sill with ample clearance with any laterally protruding structure of the center sill, such as, for example, as found in a pair of interconnected Z-shaped members. The center sill connection plate means further protects the steel center sill from corrosive materials, by forming a sealed connection with the tub member on each side. The center sill connection plate means extend along the length of the center sill and are strengthened at a central portion to suitably anchor a bracing assembly at the midpoint of the car body.

DESCRIPTION OF A PREFERRED EMBODIMENT

Figure 1:
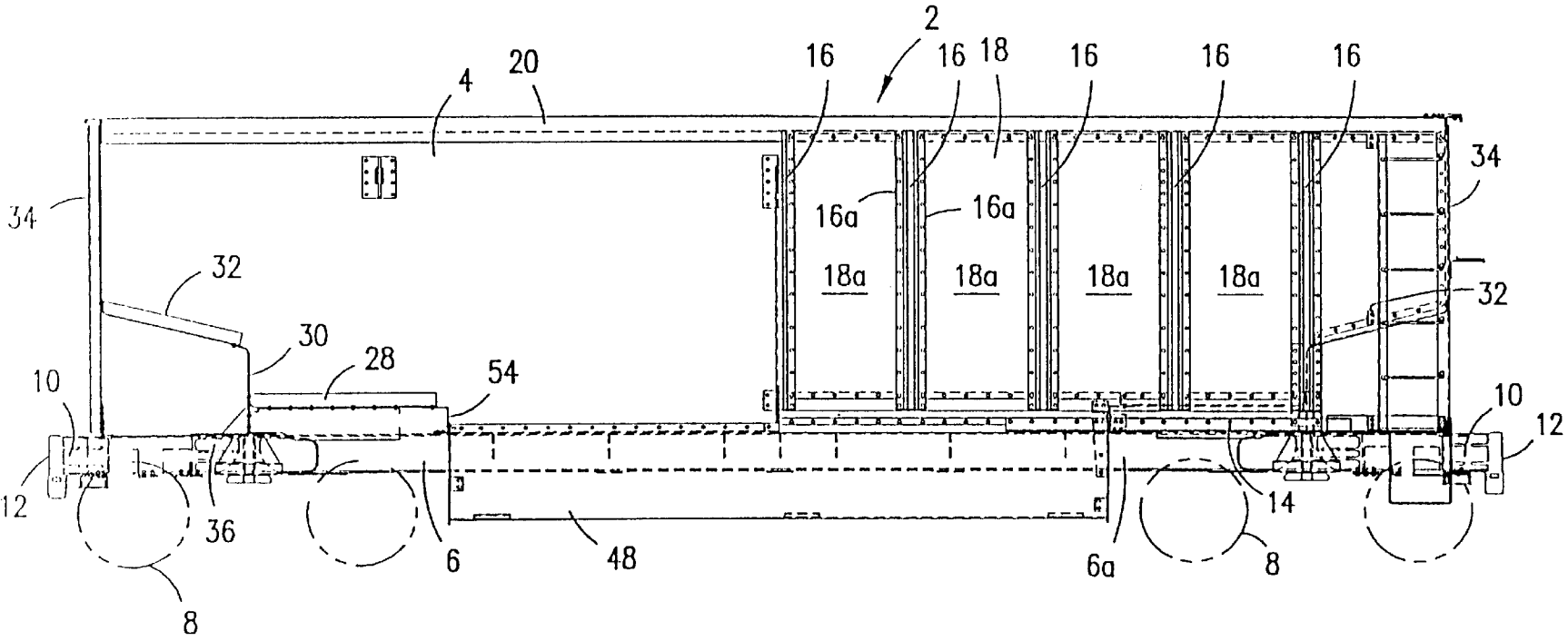
FIG. 1 is a side elevational view, with parts removed, of the gondola rail car of the invention.
Figure 2:
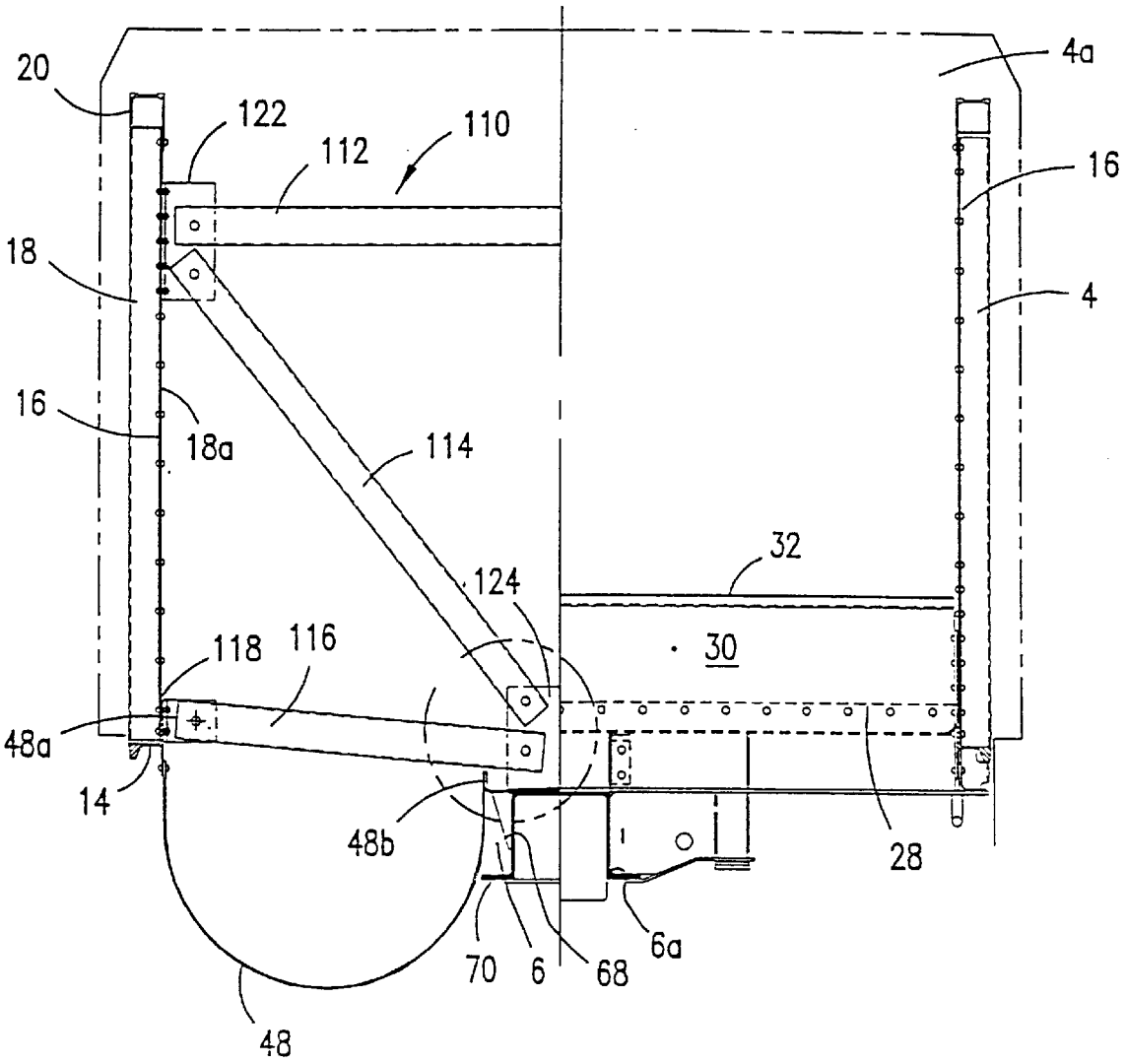
FIG. 2 is an end elevational view, with parts in section and with parts removed, of the gondola rail car of FIG. 1.
Figure 3:
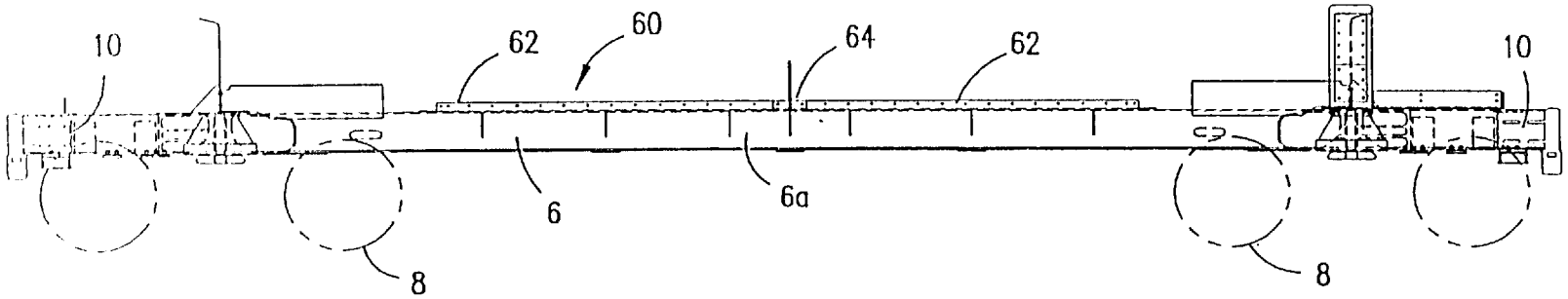
FIG. 3 is a side elevational view of the underframe of the gondola rail car of FIG. 1.

Referring now to FIGS. 1 and 2, there is illustrated the gondola rail car of the invention, generally designated by reference numeral 2. The gondola rail car 2 is provided with a upper car body 4 forming a load carrying compartment 4*a* and having an open top for receiving and discharging material to be transported. The upper car body 4 is supported by a underframe 6 which is strengthened by longitudinally extending center sill 6*a* as shown in FIGS. 1 to 5. The underframe 6 is carried by opposite truck assemblies 8 of a conventional design as seen in FIGS. 1 and 3. A draft sill 10 is mounted at each end of the center sill 6*a* to which known couplers (not shown) are provided. A striker 12 is positioned at each end of the car in a known manner.

Figure 4:
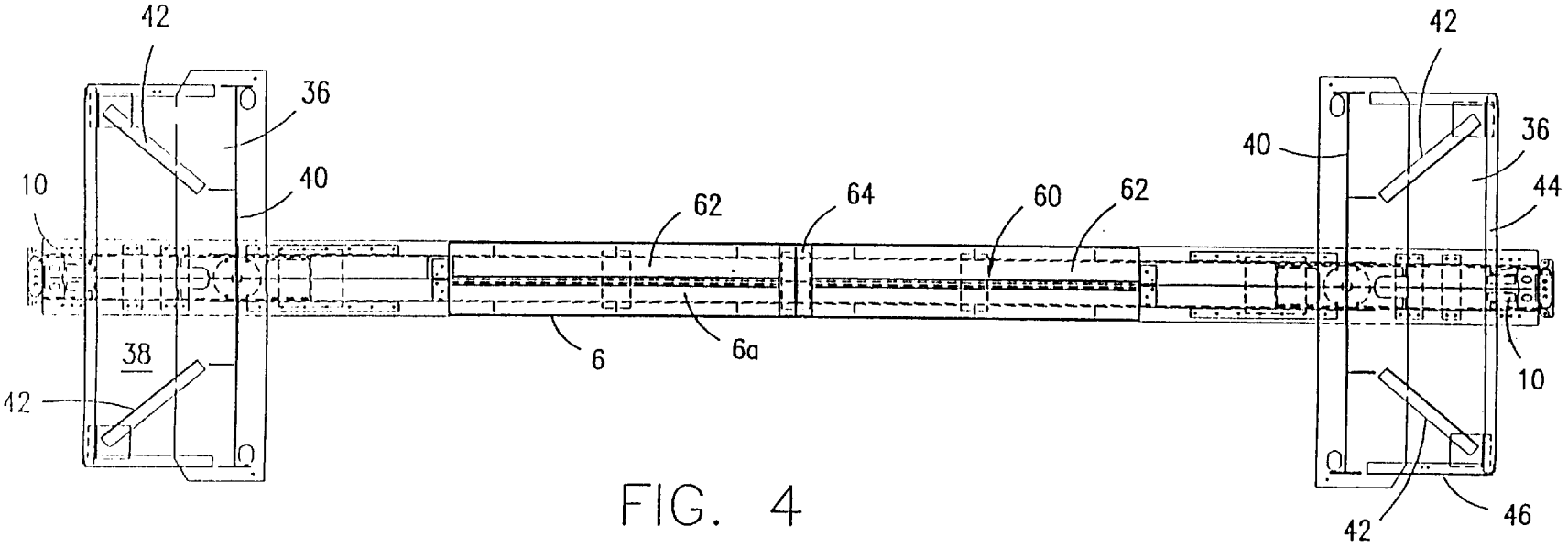
FIG. 4 is a top plan view, with parts removed, of the underframe of FIG. 3.
Figure 6:
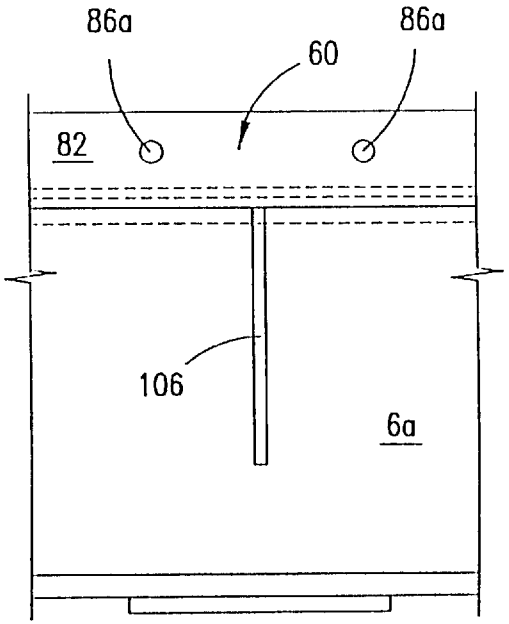
FIG. 6 is a side elevational view of the center sill connection plate of FIG. 5.

The upper car body 4 includes a pair of longitudinally extending side sills 14 on each side. The side sills are attached to vertical side stakes 16 which extend upward to form structural support of the side walls 18 of the car body 4 as seen in FIGS. 1 and 2. The side walls 18 are formed by a plurality of vertical aluminum side sheets 18*a* affixed by mechanical fasteners to flange 16*a* of the vertical side stakes 16 and at their bottom to the side sill 14. In FIG. 1, it should be understood that only the side sheets 18*a* on the right end of the car are shown, and the side sheets 18*a* extend the full length of the car in mirror image of what is shown on the right side of FIG. 1. The upper edge portions of side walls 14 are affixed by mechanical connectors to a pair of longitudinally extending upper chords 20 which extend the length of the car body 4. Referring to FIGS. 1 and 2, the end portions of car body 4 disposed above truck assemblies 8 are best shown. The car body 4 is provided with a lower horizontal floor panel 28, a lower vertical wall 30 and a sloped upper floor end wall 32 forming the body floor substantially over the truck assemblies. The ends of the car body 4 are enclosed by laterally extending upper end walls 34 fitably affixed to end beams (not shown). The end walls 34 may compose two panels interconnected by an intermediate vertical stake (not shown) as is conventional. The car body 4 is supported on the center sill by means of a bolster assembly 36. The bolster assembly 36 includes a bolster shear plate 38 and a vertical bolster web 40 that is best seen in FIG. 4. A pair of diagonal braces 42 are provided on opposite sides of the center sill above the bolster shear plate 38, and the end of the car is supported by an end sill 44 and a corner connection 46 arranged to be connected to the side sills 14.

Figure 9:
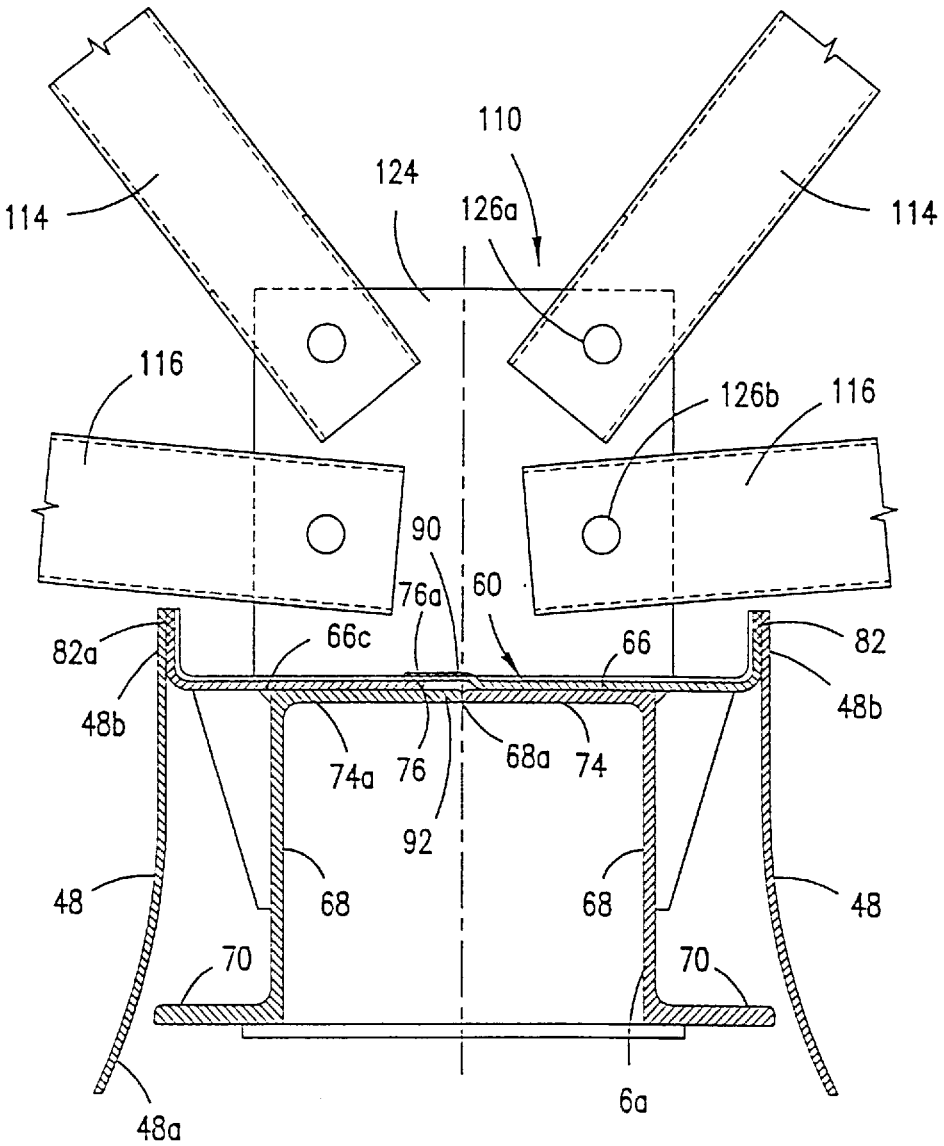
FIG. 9 is a partial end elevational view, with parts in section, showing the center center sill connection plate, the internal bracing connection to the center sill and the tub attachment of FIG. 2.
Figure 10:
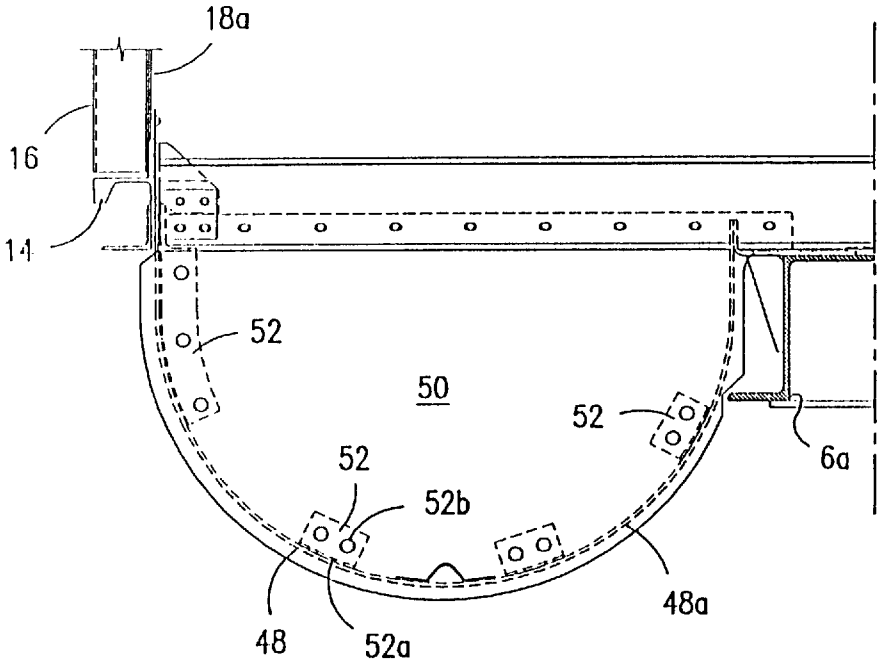
FIG. 10 is an end elevational view taken along lines 10—10 of FIG. 1 showing the enclosures of the tubs of the rail car of FIG. 1.

Referring now to FIGS. 1, 2, 9 and 10, the floor of the car body between the opposite truck assemblies 8 is formed by a pair of longitudinally extending tubs 48, one of which is shown in FIGS. 2 and 10. The tubs 48 are disposed on both sides of the center sill 6*a* and are open at their top and extend below the center sill to provide load carrying capacity on each side of the center sill. The tubs 48 are formed by curvilinear floor panels 48*a* having vertically arranged end closure plates 50 as seen in FIGS. 1 and 10. The end closure plates 50 have a semicircular configuration generally to match the shape of the tubs 48. The end closure plates 50 are affixed by mechanical fasteners by L-shaped brackets 52 having a curved portion 52*a* and a flat portion 52*b*. As seen in FIG. 1, the top 54 of the end closure plate 50 is formed with a horizontal flange to which the upper floor panel 28 is affixed by suitable connectors. In the foregoing car body, it is desirable that the end walls, floor components and the side walls be formed by a suitably lightweight, non-corrosive material, such as aluminum, while the underframe components, such as the center sill, is constructed with a material such as steel. As seen in FIG. 10, the outer edge portions of the curvilinear floor panels 48*a* are connected to the interior surface of the side sill 14 by mechanical fasteners along the length of the tubs 48.

In FIGS. 3 to 9, the center sill connection plate assembly 60 for affixing the inner upper edges 48*b* of tubs 48 to the center sill 6*a* is best shown. The center sill connection plate assembly 60 includes a pair of end center sill connection plates 62 and an intermediate reinforced center sill connection plate 64 disposed at the longitudinal mid-point portion of the car body 4 as best illustrated in FIGS. 3 and 4. The end center sill connection plates 62 are formed by a pair of L-shaped members 66, 66*a* carried on center sill 6*a* in a manner to be described. Although the invention of the application can be used with other center sill configurations, in FIG. 5 and 7, the center sill 4*a* is illustrated as having two Z-shaped portions 68 which are welded together at the top of the center sill 6*a* along seam 68*a*. The Z-shaped sections 68 of the center sill 6*a* form a horizontal lower flange 70 which projects outwardly on each side. The L-shaped members 66 and 66*a* respectively include a horizontal plate portion 74 and 74*a* having overlapping sections 76, 76*a* lying in affixed relationship on the top of center sill 6*a*. The sections 66, 66*a* project beyond the sides of the center sill 6*a* to an extent generally to be vertically aligned with or extend beyond the edge of projecting flange 70 of the center sill 6*a*. The ends of the L-shaped members 66 and 66*a* are bent upward to form vertical tub attachment flanges 82, 82*a* along their length.

Figure 5:
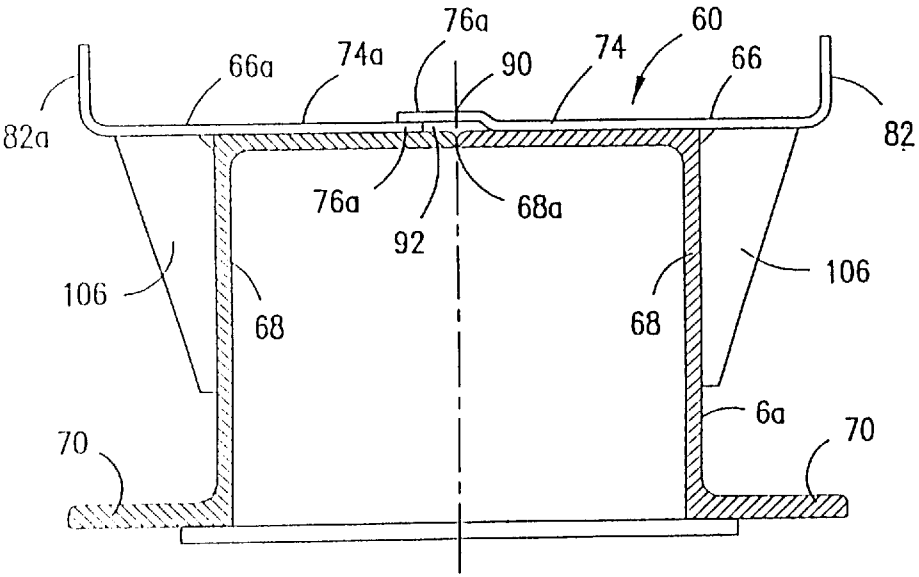
FIG. 5 is an end elevation view, with parts in section, of the center sill connection plate taken along lines 5—5 of FIG. 3.

As best seen in FIGS. 1 and 9, the upper inner edge portions 48*b* of tubs 48 are affixed to the tub mounting flanges 82 by means of mechanical fasteners 86 received in the holes 86*a* drilled along the length of flanges 82, 82*a*. As shown in FIG. 5, L-shaped member 66*a* is overlapped by a offset portion 90 of L-shaped member 66 which extends beyond the end of L-shaped member 66*a* to form a space 92 above the seam 68*a* between the two Z-shaped portions 68 of the center sill 6*a*. In practice, the weld connecting the two Z sections 68 protrudes upward above the surface of the center sill such that the space 92 accommodates such surface deviations. The end of the offset portion 90 and lower portion of L-shaped member 66*a* are welded together and welds are also present between the upper corners of the center sill 6*a* and the L-shaped members 66 and 66*a*.

Figure 8:
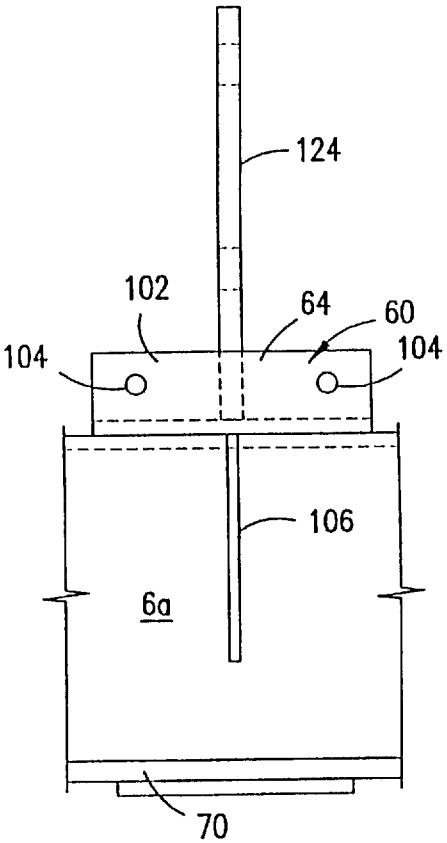
FIG. 8 is a side elevational view of the center center sill connection plate and frame anchor plate of FIG. 7.
Figure 7:
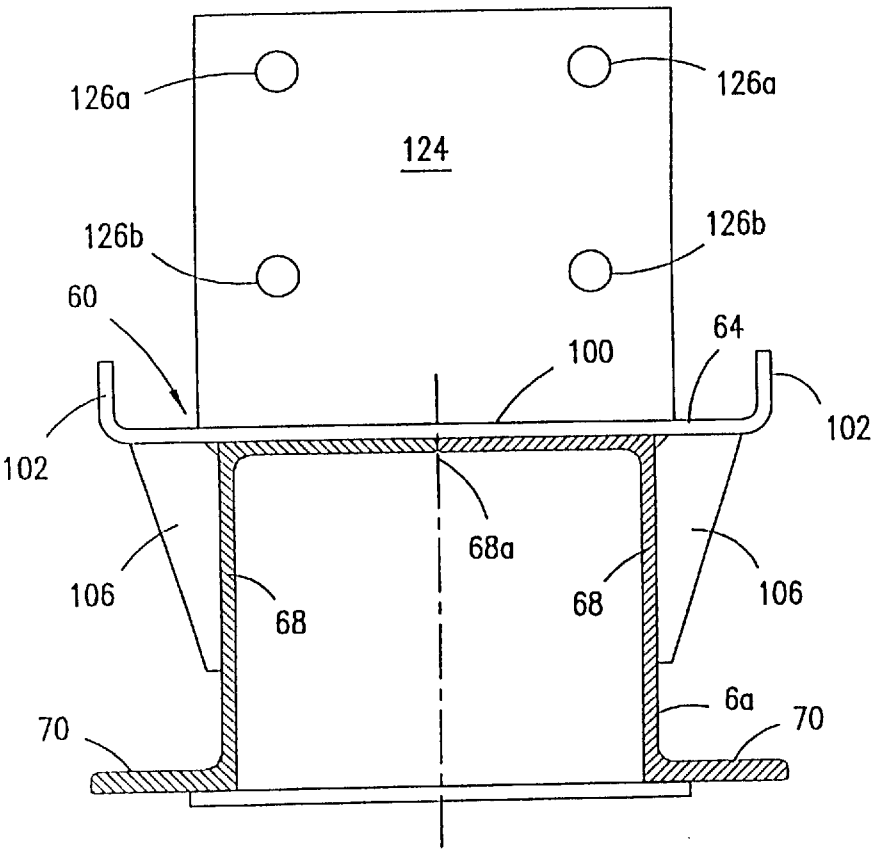
FIG. 7 is an end elevational view, with parts in section, of the center center sill connection plate and frame anchor plate taken along lines 7—7 of FIG. 3.

Referring now to FIGS. 7 and 8, the construction of the intermediate center sill connection plate 64 is best illustrated. Because the intermediate center sill connection plate 64 also serves to anchor to the intermediate frame assembly of the invention to be described, the plate 64 is formed of a single U-shaped member being generally thicker than end center sill connection plates 62. As illustrated in FIG. 7, the U-shaped member 64 includes a flat base 100 which is supported on the top of the center sill 6*a*. To accommodate the U-shaped construction of the intermediate member and provide flush contact with the top of the center sill, the weld on the top of the center sill 6*a* beneath plate 64 may be ground down to provide a flat surface. The ends of the U-shaped member 100 are bent upward to form tub attachment flanges 102 being in alignment with the flanges 82, 82*a* of the end center sill connection plates. A plurality of holes 104 is also provided on the flanges 102 (FIG. 8) to receive mechanical fasteners for attachment of the tubs 48. From the foregoing, it should be apparent that the two end center sill connection plates 62 and the intermediate connection plate 64 extend along the length of tubs 48 to affix the inner portion 48*b* of the tubs in a secure manner and provide clearance with the bottom flange 70 of the center sill 6*a*. In addition, the presence of the end center sill connection plates 62 and the intermediate center sill connection plate 64 acts as a shroud covering the steel center sill 6*a* in a manner that corrosion from the lading does not occur. The portions of the end center sill connection plate 62 and the intermediate connection plate 64 projecting from center sill 6*a* are reinforced by a plurality of braces 106 having a triangular shape as seen in FIGS. 5 through 8.

Figure 11:
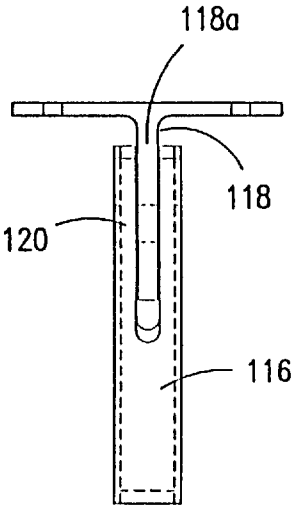
FIG. 11 is a top plan view of a bracket and lateral brace connection of the rail car of FIG.

In FIGS. 2, 7, 8, 9 and 11, there is shown the bracing assembly 110 of the invention. The bracing assembly 110 is located at the mid-point of car body 4 and braces the side walls 16 above center sill connection plate 64. In FIG. 2, only the left side of the bracing assembly 110 is shown, but the bracing assembly is identical in reversed orientation on the opposite side of the center sill 6*a*. The upper lateral beam 112 of brace assembly 110 extends the width of the car body 4 between opposite side walls 16. A diagonal beam 114 extends from adjacent the upper lateral beam 112 downward to a position affixed to the center sill 6*a*. A lower lateral beam 116 extends between a side wall 18 and the center sill 6*a*. The beams 112, 114 and 116 are preferably formed as aluminum extrusions although other materials may be utilized. In FIGS. 2 and 11, the diagonal beam 114 is attached to the side wall 18 by a T-shaped bracket 118. The stem 118*a* of the T-shaped bracket 118 is inserted into a slot 120 formed on the end of the lower lateral beam 116. A pin (not shown) extends through the stem of the T-shaped bracket and the end of the diagonal beam 116 for securement. The ends of the upper lateral beam 112 and diagonal beam 114 are similarly retained on an upper bracket 122 with a slot and pin arrangement as in FIG. 11. The diagonal beam 114 and the lower lateral beam 116 are retained on a lower vertical anchor plate 124 affixed by welds to the top of the intermediate center sill connection plate 64 at the longitudinal mid-point of the car body. As seen in FIGS. 7 and 9, the plate 124 is provided with two pairs of aligned holes 126*a* and 126*b* respectively to retain the interior ends of the diagonal beams 114 and the lower lateral beam 116 also by slot and pin arrangement such as shown in FIG. 11.

What is claimed is:

1. A rail car comprising:

a pair of opposite truck assemblies;

a body means being carried by said pair of opposite truck assemblies, said body means having a longitudinally extending center sill, wherein said center sill includes laterally extending portions;

a pair of longitudinally extending tubs being carried on opposite sides of said center sill, said tubs forming the floor of said body means;

a plate means affixed to said center sill, said plate means including a Pair of spaced, generally vertical portions which are positioned laterally of said center sill, wherein said tubs are attached to said vertical portions which are positioned laterally of said center sill to provide clearance of said tubs relative to said laterally extending portions of said center sill; and an attachment means for attaching said pair of tubs to said vertical portions of said plate means.

2. The rail car according to claim 1 wherein said plate means is affixed to the top of said center sill.

3. The rail car according to claim 1 wherein said plate means includes a plurality of braces disposed on opposite sides of said center sill, each said brace being positioned laterally between said center sill and a respective one of said tubs.

4. The rail car according to claim 3 wherein said vertical portions form opposite vertical surfaces to which a respective one of said tubs is attached along substantially the entire length of said tubs.

5. The rail car according to claim 1 wherein said vertical portions form continuous vertical surfaces along the length of said tubs.

6. The rail car according to claim 1 wherein said plate means includes a lower surface affixed to said center sill.

7. The rail car according to claim 6 wherein said lower surface is affixed to a top of said center sill.

8. The rail car according to claim 1 wherein said plate means includes a U-shaped configuration having a pair of generally vertically spaced portions and a base portion interconnecting said spaced vertical portions, said tubs being attached to said vertical spaced portions of said U-shaped configuration.

9. The rail car according to claim 8 wherein said plate means extends the length of said pair of tubs along said center sill.

10. The rail car according to claim 9 wherein said plate means includes a pair of plate members affixed side by side to each other along at least a portion of the length of said plate means.

11. The rail car according to claim 10 wherein each of said plate members forms a continuous vertical surface along at least said portion of the said plate means and a horizontal portion for attachment to a top of said center sill.

12. The rail car according to claim 11 wherein said horizontal portion of each of said plate members are generally flat and have respective end portions affixed to each other.

13. The rail car according to claim 12 wherein one of said end portions of said plate members includes an offset end portion, the other of said plate members having a flat end portion, said offset portion overlapping said flat end portion in affixed relationship.

14. The rail car according to claim 13 wherein said offset portion forms a space between said pair of plate members and said center sill.

15. The rail car according to claim 9 wherein said plate means includes a one piece U-shaped configuration along at least a portion of the length of said plate means.

16. The rail car according to claim 8 wherein said vertical spaced portions include a plurality of holes, said attachment means being a plurality of mechanical fasteners extending through said tubs and said holes for attachment of said tubs to said vertical portions.

17. The rail car according to claim 8 further including an anchor plate affixed to said plate means, a bracing assembly affixed to said anchor plate, said bracing assembly having at least one brace member extending from said anchor plate to said body means.

18. The rail car according to claim 17 wherein each said brace member includes an open ended slot at each end, said rail car further including at least one bracket means affixed to said body means and having a flat portion, and pin means for attaching one said brace member to one said flat portion.

19. The rail car according to claim 1 wherein said plate means and said tubs form a seal above said center sill to protect said center sill from corrosive material.

20. A rail car comprising:

body means being carried by a pair of opposite truck assemblies, said body means having a longitudinally extending center sill, a pair of longitudinally extending tubs being carried on opposite sides of said center sill, said tubs forming the floor of said body means, plate means affixed to said center sill, and attachment means for attaching said pair of tubs to said plate means, wherein said plate means includes a U-shaped configuration having a pair of generally vertically spaced portions and a base portion interconnecting said spaced vertical portions, said tubs being attached to said vertical spaced portions, and wherein said center sill includes laterally extending portions, said vertical surfaces of said plate means being orientated laterally of said center sill to provide clearance of said tubs relative to said laterally extending portions.

21. A rail car comprising:

a pair of truck assemblies;

a body carried by said pair of truck assemblies, said body having a longitudinally extending center sill;

a pair of longitudinally extending tubs being carried on opposite sides of said center sill, said tubs forming a floor for said body between said truck assemblies; and a plate member carried by said center sill including a horizontal portion extending laterally beyond a top surface of said center sill and at least one brace positioned laterally between said center sill and one said tub, wherein said tubs are attached to said plate member and spaced from said center sill.

22. The rail car of claim 21 wherein a plurality of said braces are positioned on opposite sides of said center sill.

23. The rail car of claim 21 wherein said plate member includes a pair of vertical flanges to which said tubs are attached.

* * * * *